United States Patent [19]

Evenson

[11] Patent Number: 4,512,480

[45] Date of Patent: Apr. 23, 1985

[54] ARTICLE HOLDING DEVICE

[75] Inventor: Mel Evenson, San Pedro, Calif.

[73] Assignee: Eldon Industries, Inc., Inglewood, Calif.

[21] Appl. No.: 522,406

[22] Filed: Aug. 11, 1983

[51] Int. Cl.[3] ..... B42F 17/00

[52] U.S. Cl. ..... 211/11; 211/184; 108/60; 312/111

[58] Field of Search ..... 211/11, 184, 50, 51, 211/55, 52; 108/60, 61, 64; 312/111, 193; 248/454, 450

[56] References Cited

U.S. PATENT DOCUMENTS

| | | | |
|---|---|---|---|
| 2,459,385 | 1/1949 | Martin | 211/51 |
| 3,269,558 | 8/1966 | Hess | 211/184 |

FOREIGN PATENT DOCUMENTS

| | | | |
|---|---|---|---|
| 635551 | 1/1962 | Canada | 211/184 |
| 2407082 | 6/1979 | France | 211/184 |
| 1596325 | 8/1981 | United Kingdom | 312/185 |

*Primary Examiner*—Ramon S. Britts
*Assistant Examiner*—Blair M. Johnson
*Attorney, Agent, or Firm*—Edward D. O'Brian; K. H. Boswell

[57] ABSTRACT

A device for organizing papers, files and the like for use in a business environment or other similar situations has a base on which one or more tilt plates are located. The tilt plates are capable of being oriented with respect to the base in a tilting mode and in a locked mode. In the tilting mode the tilt plates rotate about a bottom edge to tilt forward and backward. In the locked mode, the tilt plates are fixed in a set orientation with respect to the base. The tilt plates are easily shifted between the tilt mode and the locked mode by simply sliding them sideways a short distance on the base. Tabs on the bottom of the tilt plate maintain the tilt plate on the base and interact with a stop and lock member on the base to determine which of the modes the tilt plate is in.

30 Claims, 10 Drawing Figures

ARTICLE HOLDING DEVICE

BACKGROUND OF INVENTION

This invention is directed to an article holding device having a plurality of tilt plates which are capable of being oriented with respect to a base between a tilting mode, wherein they can tilt with respect to the base, and a fixed mode, wherein they are locked in a fixed position with respect to the base.

To assist in the organization of files, papers, magnetic recording discs and the like, there are presently available two general types of organizing devices. The first of these are fixed dividers which can be inserted into slots or the like to break up a file drawer, filing shelf, or a free standing device into individual compartments. Because the dividers in these devices are fixed with respect to the base, this type of device is primarily useful in the storage of files and the like which are withdrawn from the drawer or cabinet prior to review of the contents therein.

The second type of device which is generally available has a plurality of tilt plates which are connected to a base and can be tilted about their bottom edge. This type of device is very useful during manual collation of documents or for temporary storage of items such as invoices or the like which are actively being used during the normal business day.

Heretofore, most of the above described devices have been formed of suitable sheet metal or the like, and thus, while this material is very strong and practical for use in fixed filing cabinets and the like, it does not lend itself to usage directly on the desk of a business person because of both aesthetics and the bulk of these items. Furthermore, because of the manner of manufacturing of these devices and the material utilized in manufacturing the same, the size of the devices was fixed, and the number of dividers or tilt plates also fixed, based on parameters for an average usage. For those situations wherein a larger or a smaller size device or few or many tilt plates lead to greater usefulness and productivity, these prior devices fell short. Additionally, any expansion capability of these devices was only achievable by simply lining them up, one after the other, with no means for interconnecting the same to form larger unified structures.

BRIEF DESCRIPTION OF THE INVENTION in view of the above, it is a broad object of this invention to provide a storage and organizing device for use in general business practices which provides both a fixed mode for the dividers or tilt plates therein, as well as a tilt mode for the dividers or tilt plates therein. Further, it is a broad object of this invention to provide a device having a modular base which is capable of being attached to other modular bases, thus increasing the basic size of the device. It is a still further object of this invention to provide such a device wherein the fixed distance between the dividers or tilt plates is adjustable to the whim and will of the user, such that the device can better be accommodated to the individual tasks for which it is used. Further it is an object of this invention which, because of the engineering principles incorporated therein, is capable of a long service life in the modern business office.

These and other objects, as will be evident from the remainder of this specification, are achieved in a device which comprises: a base; said base including a support surface, said support surface having a top side and an under side; said support surface including at least one elongated opening extending through said support surface between said top side and said under side; at least one tilt plate, said tilt plate having peripheral edges, one of said edges including at least one tab means located thereon, said tab means sized and shaped so as to be positionable in said opening with at least a portion of said tab means extending beyond the underside of said support surface, said tab means movable within said opening along the elongated dimension of said opening and when said tab is so positioned in said opening at least a portion of said one edge of said tilt plate being located against said support surface so as to support said tilt plate on said support surface; at least one stop means located on said under side of said support surface in association with said opening, said portion of said tab means which extends beyond said under side of said surface abutting against said stop means when said tilt plate is oriented at an acute angle to a line which is perpendicular to said support surface, said abutting of said tab means and said stop means maintaining said tilt plate from tilting beyond said acute angle while allowing said tilt plate to freely move between said acute angle and a position wherein said tilt plate is perpendicular to the support surface; at least one lock means located on said underside of said support surface in association with said opening, said lock means for engaging with and locking said tab means, said tab means moving between an unlocked position and a locked position with respect to said lock means as said tab means moves back and forth within said elongated opening, said lock means locking said tab means when said tab means is in said locked position so as to inhibit movement of said tilt plate between said perpendicular position and said acute angle and in said unlocked position said tilt plate freely movable between said perpendicular position and said acute angle.

Preferredly, a plurality of tilt plates could be utilized in association with the support base. Further preferredly, the tab means on each of these tilt plates would include two tabs located on the tilt plate. These two tabs would simultaneously fit into two elongated openings which are aligned along a line passing through the elongated dimension of the openings. Further, preferredly the tilt plate would be tiltable to both sides of a line which is perpendicular to the support base and passes through the line connecting the two openings.

Preferredly, connecting means would be located on the base allowing for connecting of a series of the devices wherein a plurality of tilt plates can be located one behind the other, or in a second manner, wherein a plurality of tilt plates can be located side by side. Additionally, a combination of these two modes could be utilized for both a backward and forward bank, as well as a side by side bank of a series of the devices with all of the individual devices attached together to form a unified structure.

BRIEF DESCRIPTION OF THE DRAWINGS

The invention described in this specification will be better understood when taken in conjunction with the drawings wherein.

Figure 1:
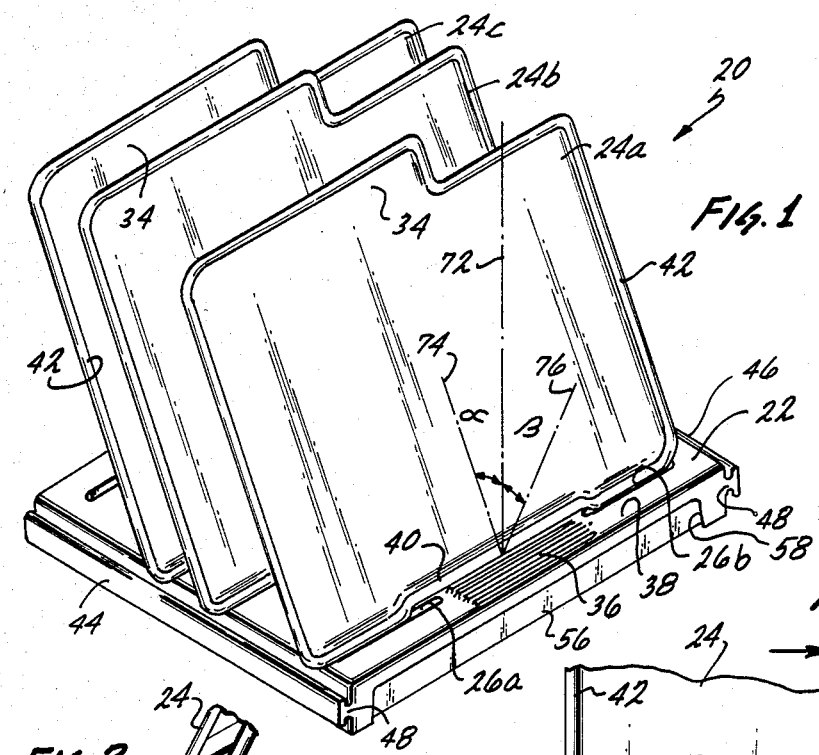
FIG. 1 is an isometric view of the device of this invention.

The invention shown in the drawings and described in the specification utilizes certain principles and/or concepts as are set forth in the claims appended to this specification. Those skilled in the arts to which this device pertains will realize that these principles and/or concepts are capable of being applied to a variety of embodiments differing from the exact embodiment utilized for illustrative purposes in this specification. For this reason, this invention is not to be construed as being limited only to the illustrative embodiment, but is only to be construed as being limited by the claims appended hereto.

DETAILED DESCRIPTION OF THE INVENTION

In FIG. 1 there is shown a single unit of the organizational device 20. It has several component parts, including a base module 22, and a plurality of identical tilt plates, collectively identified by the numeral 24. Further, the base 22 includes an array of sets of openings aligned along the base 22. In FIG. 1, openings 26*a* and 26*b*, as well as openings 28*a*, 30*a* and 32*a* are seen. The tilt plates 24*b* and 24*c* also would fit into other identical openings which are not seen in the Fig.

The tilt plates 24 are of a general rectangular nature with an area 34 raised on one side to facilitate handling of the tilt plate 24 as well as material located on the device 20. The symmetry of the tilt plates 24 is such that the tilt plates 24 can be reversed, locating the area 34 to the right hand side of the device 20, instead of on the left hand side as is seen in the Fig.

Further located on the base 22 are a plurality of ridges collectively identified by the numeral 36 which are raised above the top surface 38 of the base 22 so as to provide gripping points for the bottom of files, papers and the like as they rest on the base 22. The bottom edge 40 of the tilt plates 24 is raised slightly in its center to accommodate clearance of the tilt plate 24 over the ridges 36. Further, the totality of the periphery of the tilt plates 24 is flared to form round edge 42 which lends structural support to the tilt plate 24 as well as providing a rounded surface along the bottom edge 40 for the tilt plate 24 to roll on as the tilt plate 24 is tilted with respect to the base 22.

Along the left and right side edges of the base 22 are side connecting members 44 and 46. These are formed with a web, collectively identified by the numeral 48, having a top flange, collectively identified by the numeral 50, located thereon. Because of the presence of the top flange 50 on the web 48, the side connecting member 4 and 46 form a mortise type member.

Figure 3:
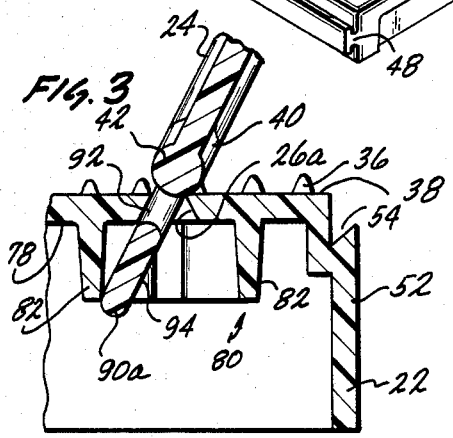
FIG. 3 is a fragmentary side elevational view in section about the line 3—3 of FIG. 2.
Figure 5:
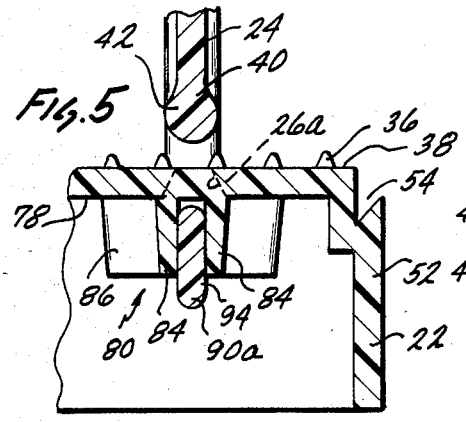
FIG. 5 is a side elevational view in section about the line 5—5 of FIG. 4.

Along the back edge, as is best seen in FIGS. 3 and 5, there is a rear connecting member 52, which is also formed as a mortise type member. There is a wedge shaped undercut 54 extending around the top and sides of the periphery of the rear connecting member 52. A front connecting member 56 is formed as a tenon type member having a wedge shaped undercut 58, seen in FIG. 10, along its side and top peripheries.

Figure 10:
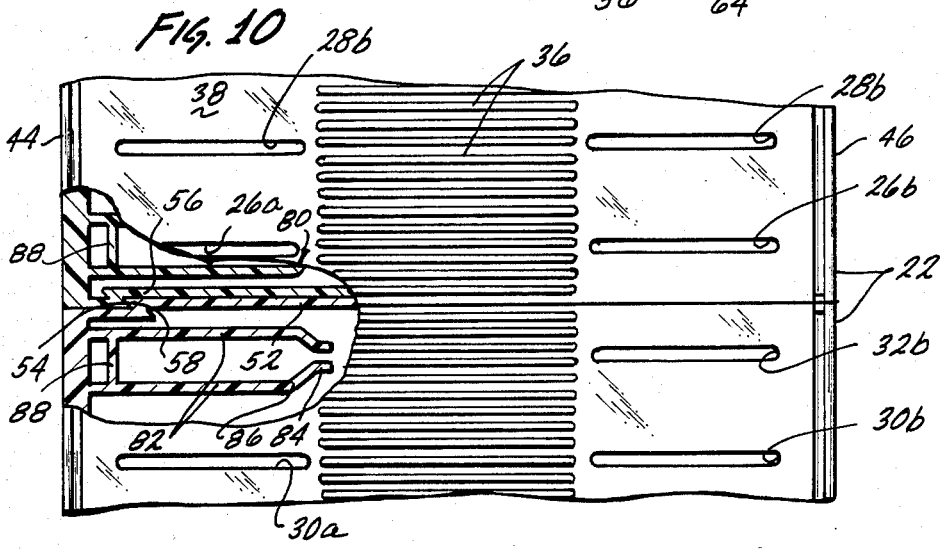
FIG. 10 is a top plan view in partial section showing the connection of two of the devices shown in FIG. 1 in a different manner, whereby two of the devices are joined about their front and rear edge respectively.

The rear connecting member 52 slides upwardly into the front connecting member 56, i.e. the mortise portion slides into the tenon portion, to connect two of the bases 22 in an in-line relationship, as is seen in FIG. 10 in the top plan view shown there. In FIG. 10, the interaction of the rear connecting member 52 as it fits into the front connecting member 56 in a male-female type fashion is evident. The edge 58 of the periphery of the front connecting member 56 fits into the undercut 54 on the rear connecting member 52 to lock the two bases 22*a* and 22*b* together, as seen in FIG. 10. A whole string of bases 22 can be so located, with one behind the other by so connecting them together by insertion of the rear connecting member 52 into the front connecting member 56. When so connected, they form a unified structure as is evident in FIG. 10, with the top surface of the particular bases 22 continuous.

For connecting two or more bases 22 in a side by side relationship, a connecting member 60 is utilized. The connecting member 60 has a central web 62 with a top flange 64 located on one end of the web 62 and an intermediate flange 66 located between the ends of the web 66. The top flange 64 has lobes, collectively identified by the numeral 68, as well as undercuts, collectively identified by the numeral 70, formed therein. The intermediate flange 66 has similar lobes and undercuts, identified by these same numerals 68 and 70, respectively.

Figure 8:
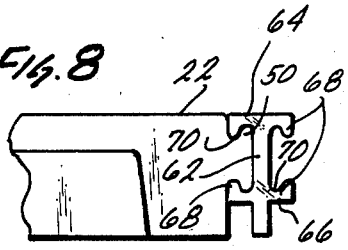
FIG. 8 is an elevational view showing the joining of two of these devices with the member seen in FIG. 7 shown in a first spatial orientation.
Figure 9:
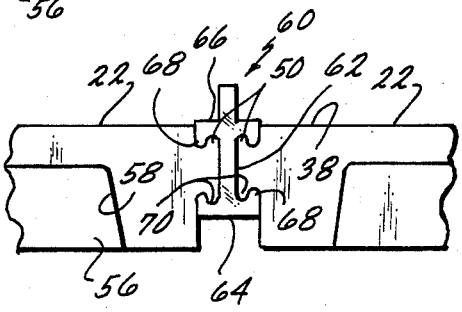
FIG. 9 is a view similar to FIG. 8 with the exception that the connecting member has been rotated 180 degrees.

The connecting member can be attached to the side connecting members 44 or 46 of the base 22 with the top flange 64 oriented upwardly as seen in FIG. 8, or oriented downwardly as seen in FIG. 9. The connecting member 60 is slid over the side connecting members 44 or 46 such that the web 48 of these members 44 and 46 is positioned between the lobes 68 on the respective flanges 64 and 66 with the top flange 50 of the side connecting members 44 and 46 positioned between the undercuts 70 on the respective flanges 64 and 66. By so utilizing the connecting member 60, two or more of the bases 22 can be aligned in a side by side relationship.

When the connecting member 60 is oriented as is seen in FIG. 8, the top surfaces 38 of the respective bases 22 are smooth, allowing for a continuous surface formed between the adjacent top surfaces 58 of two adjacent bases 22 and the top of the top flange 64. When the connecting member 60 is oriented as seen in FIG. 9, the portion of the web 62 which extends beyond the intermediate flange 66 is oriented upwardly so that it forms a divider between the two adjacent top surfaces 38 of the adjacent bases 22. This helps to maintain smaller items, such as computer memory discs and the like oriented over a particular base module 22.

If it is desirous to orient a plurality of bases 22 in both a side by side relationship as well as align them one behind the other, this can be done by joining a first series of bases 22 in a side by side relationship utilizing the connecting member 60 and a second bank of bases 22 in the same way, and then joining the first bank to the second bank by connecting them via the front and rear connecting members 52 and 56. It is thus evident that an organizing member of any size desirable can be formed, with control of both its width and its depth by appropriately choosing the number of the devices 20 which are joined together.

The tilt plates 24 can be located on the bases 22 such that they are free to tilt backward and forward or they can be fixed with respect to the bases 22 such that they do not move. In FIG. 1 the tilt plates 24*a, b* and *c* are shown in the tilt mode wherein they are free to tilt back and forth. The plate 24*a,* for instance, could be tilted forward such that it was oriented at about the same angle with respect to the base 22 forwardly as it is seen backwardly in the Fig. Stated in another way, the tilt plate 24 could be oriented at the same acute angle from a line which is perpendicular to the base at the bottom edge 40 on the fore side of the line, as it is on the far side of that line as seen in Fig. 1. Referring to the phantom lines shown in FIG. 1, the phantom line 72 would represent the perpendicular line with the phantom line 74 located in the plane of the tilt plate 24 and at an angle alpha to the line 72 and the phantom line 76 located in the plane wherein the tilt plate 24*a* would be if it was tilted forward. The acute line 76 would be at an angle beta to the line 772. The angles alpha and beta in the preferred embodiment are shown as being equal, however they could very conveniently be made to be different by simply repositioning the structural member during the manufacture of the base 22 as is indicated below.

The tilt plates 24, when in the tilt mode, as noted above are free to tilt backward and forward. They can be put onto a locked mode by simply sliding them sideways to the right as seen in FIG. 1. In the preferred embodiment, in the locked mode the tilt plates 24 would be located such that the perpendicular line 72 is in the plane of the plate 24 and as such, the tile plate 24 would be perpendicular to the base 22.

Figure 6:
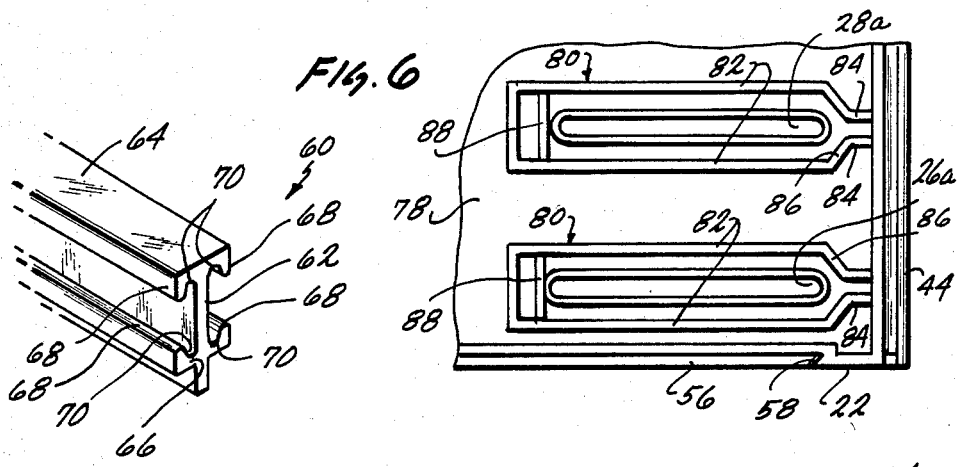
FIG. 6 is a fragmentary bottom plan view of the front right hand corner of FIG. 1.
Figure 7:
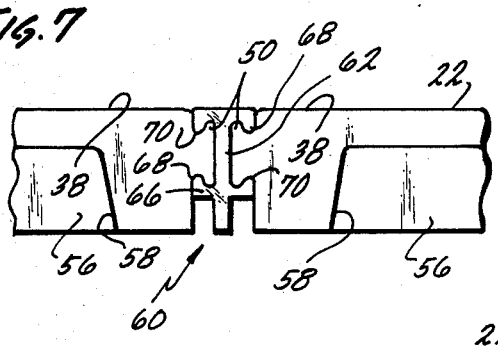
FIG. 7 is a fragmentary isometric view of a member used in association with the device of FIG. 1 to join two of these devices together.

Referring now to FIG. 6, molded on the underside surface 78 of the base 22 about the openings, such as the openings 26*b* and 28*b,* is a downwardly projecting composite member 80. The member 80 is formed of several flanges, including two elongated flanges collectively identified by the numeral 82 which are located along the two elongated sides of the respective openings, such as openings 26 and 28, two locking flanges collectively identified by the numeral 84 which are located at one of the foreshortened sides of the respective openings, connecting flanges collectively identified by the numeral 86 which connect the flanges 82 to the flanges 84 and taper the width of the member 80 from the dimension between the two flanges 82 to a narrower dimension between the two flanges 84, and finally, a guide flange 88 which connects the two flanges 82 at the other of the foreshortened sides of the respective openings, such as openings 26 and 28. The structure of the member 80 is evident from looking at the sectioned portion of FIG. 10.

The tilt plates 24 each have two identical tabs, collectively identified by the numeral 90, along their bottom edge 40. The two tabs 90 are located toward the right and left respective sides of the tilt plate 24 with the tab on the left hand side viewable in FIGS. 2 and 4. The tab on the right hand side would be identical in placement to the tab on the left hand side with these two tabs interchangeable if the tilt plate 24 is rotated 180 degrees on the base 22. Thus, the tab 90*a* seen in FIG. 2 serves as a left hand tab; however, if the tilt plate 24 in FIG. 2 was rotated 180 degrees, this would then serve as the right hand tab.

Figure 2:
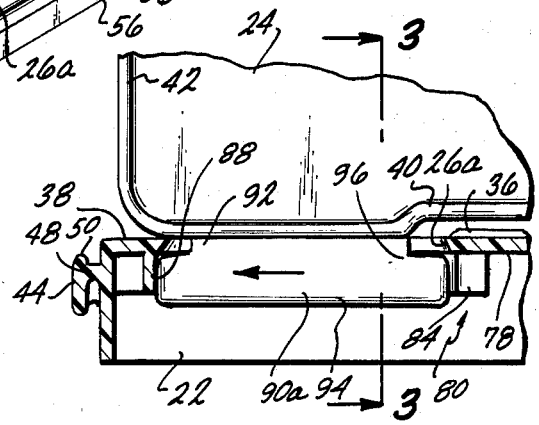
FIG. 2 is a fragmentary front elevational view of the device shown in FIG. 1.

The tabs 90 fit through the openings such as the opening 26 shown in FIGS. 2 through 5. When the tilt plates 24 are in the tilting mode, the plate 24 as seen in FIGS. 2 and 3 is shifted to the left. This locates the totality of the tab 90 between the elongated flanges 82 of the member 80. The tilt plate 24 is then free to rotate about the rounded edge 42 along the bottom edge 40. It can thus tilt forward and backward between the angles alpha and beta to the perpendicular line 72. As was noted above, the angles alpha and beta could be made different. This would be accomplished by simply moving one or the other of the elongated flanges 82 closer or further away from the opening 26. If one of the flanges 82 were moved closer to the opening 26, the angle through which the tilt plate 24 would tilt would be smaller, and if the flange 82 was moved further away from the opening 26, the angle through which the tilt plate 24 could tilt would be made greater.

The tabs 90 have a web or first area 92 which is directly connected to the tilt plate 24 and a flared or second area 94 positioned distal from the bottom edge 40 of the tilt plate 24. It is the second area 94 which contacts the elongated flanges 82 when the tilt plate 24 is in the tilt position. In FIG. 3, in tilting the tilt plate 24 from the orientation in which it is seen by rotating it counterclockwise about the round edge 42, the area 90 moves from its contact with the flange 82 on the left hand side to contact against the flange 82 on the right hand side.

Figure 4:
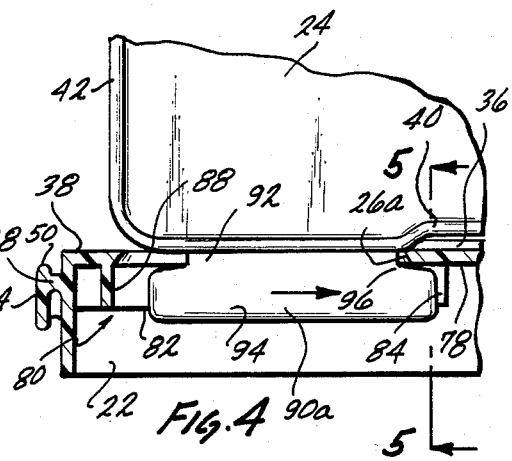
FIG. 4 is a view similar to FIG. 2 with the exception that one of the components in the FIG. has been moved to a different spatial orientation with respect to another of the components as compared to the spatial orientation of the components seen in FIG. 2.

When the tilt plate 24 is placed into the locking mode, the tilt plate 24 is slid to the right as viewed in FIG. 1, which allows the edge 96 dividing the top and under surfaces 38 and 78 of the base 22 to slide into the undercut area 96 located adjacent to the ends of the web or first area 92 of the tabs 90. This positions the flared or second area 94 of the tab 90 in between the locking flanges 84 to fixedly hold the tilt plate 24 in an upright orientation with respect to the base 22. This is seen in FIGS. 4 and 5. A member 80 is located under each opening such that both the right and left tabs 90 become locked between appropriate locking flanges 84 on the right and left members 80 to hold the tilt plates 24 at both their right and left sides to better support the same. Thus, for each set of openings, such as openings 26, a like set of members 80 would be located underneath them, such that each of the tilt plates 24 is held to the base 22 by location of the two of its two tabs 90 in the two respective openings and each of the tilt plates 24 is held in the locked position by interaction of both of its tabs 90 with appropriate locking flanges 84. To assist in moving the tilt plates from the tilt to the locked position, the connecting flanges 86 guide the flared or second area 94 of the tabs 90 into the locking flanges 84.

To assist in convenient tilting of the tilt plates 24 backward and forward, the guide flange 88 on the other end of the openings serves as a surface which is contacted by the left hand edge of the flared area 94 as seen in FIG. 2 as the tilt plate 24 moves backward and forward. This assists in the smooth operation of the tilt plate 24 when it is in the tilt mode. It, of course, can be appreciated that one of the tilt plates, such as tilt plate 24*a* could be in the locked mode simultaneously with other of the tilt plates, such as tilt plate 24b being in the tilt mode. This lends to the versatility of the device 20. Of course, any particular tilt plate 24 can be quickly moved between the locking and the tilting modes by simply sliding the tilt plate 24 with respect to the base 22 a small increment either to the left or the right depending upon the spatial orientation of the base 22.

I claim:

1. A device which comprises:

a base module;

said base module including a support surface, said support surface having a top side and an under side;

said support surface including at least one elongated opening extending through said support surface between said top side and said under side;

at least one tilt plate, said tilt plate having peripheral edges, one of said edges including at least one tab means located thereon, said tab means sized and shaped so as to be positionable in said opening with at least a portion of said tab means extending beyond the underside of said support surface, said tab means movable within said opening along the elongated dimension of said opening in response to movement of said tilt plate along said elongated dimension and when said tab is so positioned in said opening at least a portion of said one edge of said tilt plate being located against said support surface so as to support said tilt plate on said support surface;

at least one stop means located on said under side of said support surface in association with said opening, said portion of said tab means which extends beyond said under side of said surface abutting against said stop means when said tilt plate is oriented at an acute angle to a line which is perpendicular to said support surface, said abutting of said tab means and said stop means maintaining said tilt plate from tilting beyond said acute angle while allowing said tilt plate to freely move between said acute angle and a position wherein said tilt plate is perpendicular to the support surface;

at least one lock means located on said underside of said support surface in association with said opening, said lock means for engaging with and locking said tab means, said tab means moving between an unlocked position and a locked position with respect to said lock means as said tab means moves back and forth within said elongated opening in response to movement of said tilt plate along the elongated dimension of said opening, said lock means locking said tab means when said tab means is in said locked position so as to inhibit movement of said tilt plate between said perpendicular position and said acute angle and when said tab means is in said unlocked position said tilt plate freely movable between said perpendicular position and said acute angle.

2. The device of claim 1 wherein:

said stop means includes a first portion and a second portion, both said first and said second portions associated with said opening and located on said underside of said support surface in positions so as said tab means abutts against said first portion when said tilt plate is oriented at an acute angle to said perpendicular line when said tilt plate is on one side of said perpendicular line and said tab means abutting against said second section when said tilt plate is oriented at an acute angle to said perpendicular line on the other side of said perpendicular line.

3. The device of claim 2 wherein said opening including a periphery, said periphery of said opening includes two elongated sides connected at their ends by two foreshortened sides;

said first portion of said stop means located in association with one of said two elongated sides and said second portion of said stop means located in association with the other of said two elongated sides.

4. The device of claim 3 wherein:

said lock means is located in association with one of said foreshortened sides.

5. The device of claim 4 wherein:

said first portion of said stop means comprises a first flange located on the underside of said support surface and positioned in association with one of said sides of said opening, said second portion of said stop means comprises a second flange located on the underside of said support surface and positioned in association with the other side of said opening.

6. The device of claim 5 wherein:

said lock means comprises a third and a fourth flange located on the underside of said support surface and positioned in association with one of said foreshortened sides of said opening, a portion of said tab means located between and fixedly held by said third and said fourth flange when said tab means is in said locked position.

7. The device of claim 6 including:

said support surface having at least one set of two of said openings with said two of said openings of said set aligned along a line passing through the elongated dimension of each of said openings of said set, each of said two of said openings in said set including a stop means and a lock means associated with the respective openings;

said tab means comprising said tilt plate having two of said tabs located thereon and spaced with respect to each other on said one of said edges of said tilt plate such that said one of said tabs is positionable in one of said openings of said set when the other of said tabs is positionable in the other of said openings of said set, each of said tabs interacting with said stop means and said lock means at said respective openings.

8. The device of claim 7 including:

a plurality of said sets of two openings each, said plurality of said sets of openings spaced apart one from the other along said support surface in an array.

9. The device of claim 8 including:

a plurality of said tilt plates.

10. The device of claim 9 further including:

each of said tabs on each of said tilt plates having a first area and a second area, said first area located adjacent to said one of said edges of said tilt plate and said second area connecting to said first area with said first area interspaced between said second area and said tilt plate, said first area being of a smaller dimension than said second area.

11. The device of claim 10 wherein:

each of said tabs is elongated and is essentially planar, said second area having first and second ends both of which extend outwardly beyond said first area so as to form first and second undercuts on the sides of said tab adjacent to said one edge of said tilt plate, a portion of said support surface located adjacent to said foreshortened side of said opening wherein said third and said fourth flanges are located fitting into one of said undercuts when said tilt plate is in said locked position.

12. The device of claim 11 further including:

connecting flanges associated with each of said openings, said connecting flanges connecting said first flange to said third flange and said second flange to said fourth flange.

13. The device of claim 12 including:

guide flange located at the other of said foreshortened sides of said opening wherein said lock means is not located and extending between said first and said second flanges connecting said first and said second flanges together, one of said ends of said second area of said tab sliding against said guide flange as said tilt plate tilts between said acute angle and said perpendicular line.

14. The device of claim 1 including:

said support surface having at least one set of two of said openings with said two of said openings of said set aligned along a line passing through the elongated dimension of each of said openings of said set;

said tab means comprising said tilt plate having two tabs located thereon and spaced with respect to each other on said one of said edges of said tilt plate such that one of said tabs is positionable in one of said openings of said set when the other of said tabs is positionable in the other of said openings of said set.

15. The device of claim 14 including:

a plurality if said sets of two openings each, said plurality of said sets of openings spaced apart one from the other in an array on said support surface.

16. The device of claim 1 further including:

a first connecting means and a second connecting means located on said base module, said first connecting means of a first of said devices connectable to said second connecting means of a second of said devices so as to temporarily connect said first of said devices to said second of said devices.

17. The device of claim 16 wherein:

said first connecting means comprise mortise means and said second connecting means comprises tenon means each positioned on said base so as said mortise means on said first of said devices is connectable to said tenon means on said second of said devices.

18. The device of claim 17 wherein:

said base module has at least three sides with each of said sides including an edge oriented essentially perpendicular to said support surface, said mortise means located along one of said edges and said tenon means located along a further of said edges.

19. The device of claim 18 wherein:

each of said mortise means and said tenon means is dovetailed in shape and sized so as to allow said tenon means to lock in said mortise means.

20. The device of claim 16 wherein:

said first and said second connecting means are identical in shape and further including a connecting member, said connecting member interlocking with both said first and said second connecting means so as to temporarily connect said first of said devices to said second of said devices.

21. The device of claim 18 including:

a third of said sides having a third connecting means located thereon;

and further including a connecting member capable of interlocking with two of said third connecting means wherein one of said third connecting means is located on a first of said devices and the other of said third connecting means is located on a second of said devices, said connecting member temporarily connecting to each of said third connecting member.

22. The device of claim 21 wherein:

said connecting member includes a first and a second further mortise means and said third connecting means comprising a further tenon means, said further mortise means temporarily connecting to said further tenon means to temporarily connect said connecting member to said first and said second of said devices.

23. The device of claim 8 including:

a first connecting means and a second connecting means located on said base module, said first connecting means of a first of said devices connectable to said second connecting means of a second of said devices so as to temporarily connect said first of said devices to said second of said devices.

24. The device of claim 23 wherein:

said first connecting means comprise mortise means and said second connecting means comprises tenon means each positioned on said base so as said mortise means on said first of said devices is connectable to said tenon means on said second of said devices.

25. The device of claim 24 wherein:

said base module has at least three sides with each of said sides including an edge oriented essentially perpendicular to said support surface, said mortise means located along one of said edges and said tenon means located along a further of said edges;

each of said mortise means and said tenon means is dovetailed in shape and sized so as to allow said tenon means to lock in said mortise means.

26. The device of claim 25 wherein:

a third of said sides having a third connecting means located thereon;

and further including a connecting member capable of interlocking with two of said third connecting means wherein one of said third connecting means is located on a first of said devices and the other of said third connecting means is located on a second of said devices, said connecting member temporarily connecting to each of said third connecting member.

27. The device of claim 26 wherein:

said connecting member includes a first and a second further mortise means and said third connecting means comprising a further tenon means, said further mortise means temporarily connecting to said further tenon means to temporarily connect said connecting member to said first and said second of said devices.

28. The device of claim 6 wherein:

a first connecting means and a second connecting means located on said base module, said first connecting means of a first of said devices connectable to said second connecting means of a second of said devices so as to temporarily connect said first of said devices to said second of said devices.

29. The device of claim 7 wherein:

a first connecting means and a second connecting means located on said base module, said first connecting means of a first of said devices connectable to said second connecting means of a second of said devices so as to temporarily connect said first of said devices to said second of said devices.

30. The device of claim 29 wherein:

said first connecting means comprise mortise means and said second connecting means comprises tenon means each positioned on said base so as said mortise means on said first of said devices is connectable to said tenon means on said second of said devices;

said base module has at least three sides with each of said sides including an edge oriented essentially perpendicular to said support surface, said mortise means located along one of said edges and said tenon means located along a further of said edges;

a third of said sides having a third connecting means located thereon;

and further including a connecting member capable of interlocking with two of said third connecting means wherein one of said third connecting means is located on a first of said devices and the other of said third connecting means is located on a second of said devices, said connecting member temporarily connecting to each of said third connecting member.

* * * * *

UNITED STATES PATENT AND TRADEMARK OFFICE

CERTIFICATE OF CORRECTION

PATENT NO. : 4,512,480

DATED : APRIL 23, 1985

INVENTOR(S) : MEL EVENSON

It is certified that error appears in the above-identified patent and that said Letters Patent is hereby corrected as shown below:

In the Abstract, line 12, at the beginning of the line "the tilt plate" should read --each tilt plate--.

Column 4, line 7, "member 4" should be --members 44--.

Column 4, line 38, "web 66" should be --web 62--.

Column 4, line 58, "top surfaces 58 " should read --top surfaces 38--.

Column 5, line 30, "line 772" should read --line 72--.

Column 5, line 41, "tile" should be --tilt--.

Column 6, line 38, "edge 96" should read --edge 26a--.

Column 9, Line 35, "if" should be --of--.

Column 9, line 46, "comprise" should be --comprises--.

Column 10, line 28, "comprise" should be --comprises--.

Column 11, line 10, "comprise" should be --comprises--.

Signed and Sealed this

*Twenty-fourth* Day of *December 1985*

[SEAL]

*Attest:*

DONALD J. QUIGG

*Attesting Officer*

*Commissioner of Patents and Trademarks*